United States Patent [19]

Morgan

[11] 4,194,516

[45] Mar. 25, 1980

[54] CIGARETTE HOLDER

[76] Inventor: Jerome Morgan, 149 S. 15th Ave., Maywood, Ill. 60153

[21] Appl. No.: 843,864

[22] Filed: Oct. 20, 1977

[51] Int. Cl.[2] ..... A24F 13/16

[52] U.S. Cl. ..... 131/174

[58] Field of Search ..... 131/174, 175, 191, 187, 131/257, 259, 193

[56] References Cited

U.S. PATENT DOCUMENTS

| | | | |
|---|---|---|---|
| 1,498,190 | 6/1924 | Morrier | 131/174 |
| 1,647,322 | 11/1927 | Valero | 131/174 |

FOREIGN PATENT DOCUMENTS

| | | | |
|---|---|---|---|
| 27947 | 1/1894 | Fed. Rep. of Germany | 131/174 |
| 547662 | 5/1956 | Italy | 131/174 |
| 18234 | of 1908 | United Kingdom | 131/174 |

*Primary Examiner*—Stephen C. Pellegrino

*Attorney, Agent, or Firm*—Robert D. Farkas

[57] ABSTRACT

A cigarette holder utilizes an elongated cylindrical tube having one end thereof and the cylindrical surface thereof fabricated with a plurality of regular openings defining a screen. A finger grasping wire-like element is secured to a portion of the cylindrical surface of the screen having an end thereof extending parallel to the longitudinal axis of the tube-like screen. Attached to the free end of the wire-like element is an alligator clip. In use, a cigarette is clamped between the jaws of the alligator clip adjacent the end of the cigarette adapted to be inserted in the user's mouth. The lit end of the cigarette is disposed within the screen, facilitating the use of the apparatus such that virtually all of the cigarette may be consumed whilst having the ash portion of the cigarette confined within the screen eliminating fire hazards caused by portions of the cigarette sputtering during the smoking operation.

7 Claims, 2 Drawing Figures

CIGARETTE HOLDER

BACKGROUND OF THE INVENTION

1. The Field Of The Invention

This invention relates to cigarette holders and cigarette guards combined into a unitary apparatus.

2. Description Of The Prior Art

The prior art abounds with cigarette holders of wide variety. U.S. Pat. No. 1,647,322 issued on Nov. 1, 1927 to J. S. Valero teaches a pair of clamshell-like wire mesh screens hinged to one another and having an open mouth portion adapted to grip a portion of the periphery of a cigarette therein. A handle is attached to one of the screen elements useful by grasping by the fingers of the user. Such device suffers the deficiency of requiring the apparatus to be expensive to manufacture in that the bifurcated screen element must be carefully machined so as to eliminate the possibility that sputtering wastes of the cigarette may accidentally emerge from the screen shroud at the location where the screen shroud element engage one another when closed.

U.S. Pat. No. 1,931,732 issued Oct. 24, 1933 to N. A. Lanzillotti el al discloses an elongated cigarette holder fabricated from a rigid material, one end of the holder is adapted to be inserted in the mouth of the user, the other end of the holder is adapted for insertion of one end of a lit cigarette thereinto. A ring is secured to the holder along a portion of the surface of the length thereof adapted to have a forefinger of a user inserted therein. Such apparatus, though convenient to use and support a cigarette therein, suffers the deficiency of not providing any form of shroud in which the cigarette ash and lit particles emerging from the lit end of the cigarette may be contained.

U.S. Pat. No. 2,827,059 issued on Mar. 18, 1958 to A. Czap discloses a cigarette shroud fabricated from a metallic element having a plurality of annular grooves disposed therein forming a type of screen. Attached to one end of the tubular screen is a conventional cigarette holder fabricated from a rigid material and adapted to have one end thereof in use by insertion in a user's mouth. The other end of the holder is provided with an opening in which the unlit portion of the cigarette may be disposed. This invention teaches an apparatus suitable for encasing the lit end of a cigarette therein, but does not at all provide facility for smoking a cigarette down to the very nub by virtue of that portion of the cigarette which is retained within the rigid holder. Of similar design is the apparatus patented by E. Mason on May 5, 1959 bearing U.S. Pat. No. 2,884,830. Such apparatus differs only from the apparatus of Czap in terms of the screen element encasing the cigarette. However, the Mason's teaching suffers the same deficiency as that of the disclosure to abide Czap.

SUMMARY OF THE INVENTION

A primary object of the present invention is to provide a cigarette holder which permits a cigarette to be smoked down to the very end without burning the fingertips grasping the cigarette.

Another object of the present invention is to provide a cigarette holder which enables a cigarette to be totally smoked whilst screening the lit end of the cigarette from accidental dislodgement of particles of burnt cigarette ash.

Still another object of the present invention is to provide a cigarette holder whose cigarette grasping portion is adapted to clip onto the unlit end of a cigarette so that the grasping portion and the cigarette may be simultaneously clenched between pursed lips of the user.

Yet another object of the present invention is to provide a cigarette holder having a convenient finger grasping portion disposed away from the end of the cigarette adapted for insertion in the mouth of the user and guarded from accidental contact with the lit end of such cigarette.

Another object of the present invention is to provide a cigarette holder whose manufacturing costs and utility is particularly advantageous for the intended purposes of the device.

Heretofore, cigarettes were available at low cost. Due to the increased cost of labor in the manufacturing process of cigarettes and the cost of gathering tobacco or other materials used in cigarette manufacture, it is highly desirable to smoke cigarettes along a greater portion of the length than before. Furthermore, cigarettes tend to have portions of the lit end thereof sputter and burn at a non-uniform rate such that large ignited particles leave the area of the cigarette which is ignited with considerable force and high speed, creating a fire hazard as well as a hazard to the clothes of the user. Thus, it is highly desirable to shield virtually the entire length of a cigarette from such accidentally emerging burning particles. When smoking a cigarette so that a small portion of the length of the cigarette remains, a further problem of holding the cigarettes satisfactorily between the fingers of the user is encountered.

The present invention recognizes these difficulties and provides an apparatus which thoroughly, effectively and economically provide a screen-type shield along virtually the entire length of the cigarette in combination with a cigarette grasping means adapted to grasp the extreme ends of the cigarette wherein such end may be inserted between the lips of the user including the cigarette grasping portion of the apparatus. A finger grasping portion of the apparatus is provided extending away from the end of the cigarette grasping portion thus permitting the user to manually grasp and release the finger grasping portion of the apparatus conveniently and with great ease. The present invention may be manufactured at extremely low cost so as to be virtually disposable, rugged in construction, easily cleaned, whilst presenting a neat and finished appearance.

These objects as well as other objects of the present invention will become more readily apparent after reading the following description of the accompanying drawings.

DESCRIPTION OF THE PREFERRED EMBODIMENT

The structure and method of fabrication of the present invention is applicable to a cylindrical type screen, preferably fabricated from metal screening and having a cylindrical elongated surface. The open mouth portion and the passageway within the screen is of length and diameter configured to contain therein virtually the entire length of a cigarette, having the lit end thereof disposed adjacent to the cap end of the screen and having the unlit end thereof exxtending slightly outwardly from the open mouth portion. The longitudinal axis of the cigarette is disposed substantially concentrically with the longitudinal axis defining the cylindrical surface of the screen. A helix of wire-like material, preferably fabricated from a metallic material such as steel, has an outermost turn thereof secured to the cylindrical surface of the screen such that the plane defining the helical turn contains the longitudinal axis of the cylindrical screened surface. The free end of the helix extends parallel to the longitudinal axis of the screen tube and terminates outwardly from the open mouth portion of the screen tube. Such free end serves as the axle for an alligator clip whose tongue-like arms are pivoted about the wire-like element free end having their cigarette grasping ends biased toward one another utilizing a spring element fastened to the free end of the wire-like element and impartially encircling same. Thus, a cigarette may be inserted between the clamping ends of the arms of the alligator clips when the other ends of the arms of the alligator clip are squeezed together permitting the unlit end of the cigarette to be grasped by the cigarette engaging ends of the arms of the alligator clip. Releasing the alligator clip permits the spring to engage the unlit end of the cigarette. In use, a thumb and adjacent forefinger of one hand of the user is grasped about the helical turn defining the finger grasping portion of the apparatus. When it is desired to inhale cigarette smoke, the cigarette engaging ends of the alligator clip and the unlit ends of the alligator clip may be placed between the lips of the user so as to provide a convenient way of inhaling cigarette smoke when the cigarette has been smoked down to a small remaining unlit length. It is to be noted that the grasping portion of the present invention is guarded by the screen and is disposed away from the unlit end of the cigarette facilitating positioning of the hand of the user a substantial distance away from the mouth of the user when the cigarette is smoked virtually to the end thereof.

Figure 1:
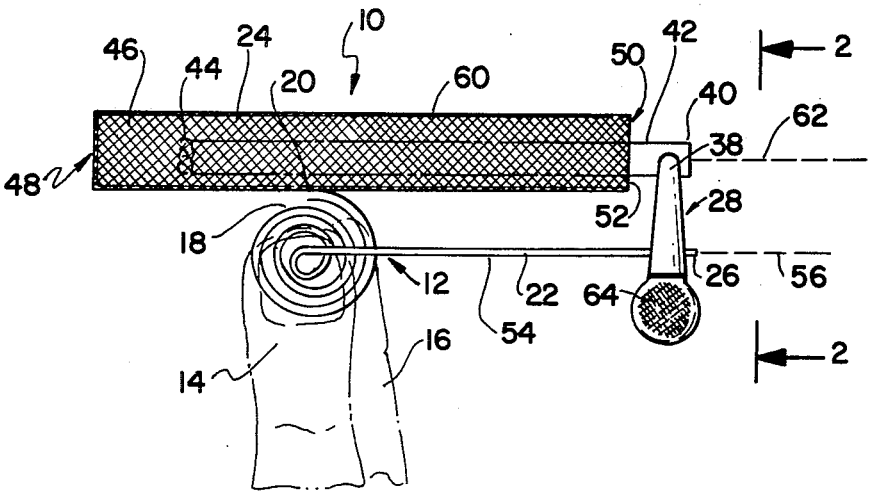
FIG. 1 is a side elevation view of the present invention shown grasped by the fingers of a user and being used in conjunction with a lit cigarette.

Now referring to the figures, and more particularly to the embodiment illustrated in FIG. 1 showing the present invention 10 shown having a finger grasping portion 12 thereof grasped by thumb 14 and index finger 16 about helical wire turns 18. End 20 of wire-like element 22 is secured to screening 24 by a process equivalent to welding. End 26 is shown secured to alligator clip 28 having end 38 thereof shown secured to unlit end 40 of cigarette 42. Lit end 44 of cigarette 42 is shown confined within a cylindrical surface 46 of screening 24. End 48 of screening 24 is also fabricated from a screening material. Open mouth portion 50, of screening 24, permits portion 52 of cigarette 42 to pass thereinto. Portion 54 of wire-like element 22 is adapted to have longitudinal axis 56 thereof disposed parallel to longitudinal screening surface 60. Dotted lines 62 depict the longitudinal axis of screening 24 about which cylindrical surface 60 is uniformly located. End 38 of alligator clip 28 may be opened away from end 40 of cigarette 42 by a manual force applied to end 64 of alligator clip 28.

Figure 2:
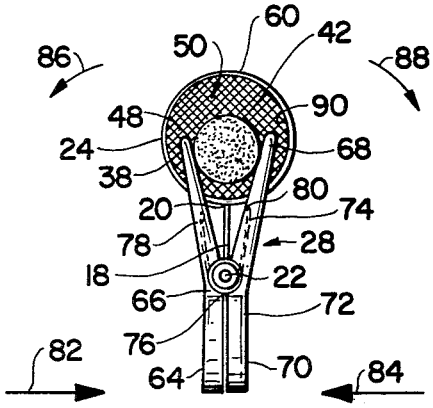
FIG. 2 is a cross-sectional side elevation view, taken along lines 2—2, viewed in the direction of arrows 2—2, shown in FIG. 1.

FIG. 2 illustrates alligator clip 28 shown attached to wire-like element 22 and having end 64 and ends 38 of arm 66 opposed to end 68 and ends 70 of arm 72. Arm 72 and arm 66 pivot in reciprocating fashion about wire-like element 22, utilizing the same as an axle. Spring element 74 has portion 76 thereof disposed partially wrapped about wire-like element 22 such that ends 78 and 80 thereof urge ends 38 and 78 of arms 66 and 72 respectively together. A force, directed in the direction of arrow 82, exerted on end 64 coupled with another force, exerted in the direction of arrow 84 on end 70 of arm 72 cause ends 38 and 68 to move in the direction of arrows 86 and 88. At such time, cigarette 42 may be removed from open mouth portion 50 of cylindrical screening surface 60. Cap 48 is shown whilst peering along the interior surface 90 formed by cylindrical portion 60 of screening 24. Helical turn 18 is shown attached to cylindrical surface 60 at point 20 intermediate the jaws formed by end 38 and 68 of arms 66 and 72.

One of the advantages of the present invention is to provide a cigarette holder which permits a cigarette to be smoked down to the very end without burning the fingertips grasping the cigarette.

Another advantage of the present invention is to provide a cigarette holder which enables a cigarette to be totally smoked whilst screening the lit end of the cigarette from accidental dislodgement of particles of burnt cigarette ash.

Still another advantage of the present invention is to provide a cigarette holder whose cigarette grasping portion is adapted to clip onto the unlit end of a cigarette so that the grasping portion and the cigarette may be simultaneously clenched between pursed lips of the user.

Yet another advantage of the present invention is to provide a cigarette holder having a convenient finger grasping portion disposed away from the end of the cigarette adapted for insertion in the mouth of the user and guarded from accidental contact with the lit end of such cigarette.

Another advantage of the present invention is to provide a cigarette holder whose manufacturing costs and utility is particularly advantageous for the intended purposes of the device.

Thus, there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

I claim:

1. A cigarette holder comprising an elongated cylindrical tube of screening, one end of said tube having an open mouth portion, the other end of said tube having a circular cap of screening fixedly secured thereto, a wire-like element, one end of said wire-like element having a flat helical shape, said flat helical shape having a portion thereof fixedly secured to the exterior surface of said tube at a location intermediate the ends thereof, a portion of the length of said wire-like element adjacent the other end of said wire-like element extending parallel to the longitudinal axis of said tube and spaced parallelly and outwardly from the exterior surface of said tube, said portion of said wire-like element substantially residing in a plane defined by said flat helical shape, a pair of arms, each of said pair of arms pivotably secured to said other end of said wire-like element, means to bias one end of each of said arms toward one another, the other end of said each of said arms extending outwardly from said other end of said wire-like element, the longitudinal axis of each of said pair of arms extending perpendicular to said other end of said wire-like element.

2. The apparatus as claimed in claim 1 wherein said means to bias said pair of arms comprise a spring, said spring having the ends thereof engaging said each of said pair of arms and urging a portion of said each of said pair of arms towards one another.

3. The apparatus as claimed in claim 1 wherein the longitudinal axis of said tube is disposed residing in said plane.

4. The apparatus as claimed in claim 1 wherein said wire-like element comprises steel.

5. The apparatus as claimed in claim 1 wherein said pair of arms and said means to bias said pair of arms comprises an alligator clip.

6. The apparatus as claimed in claim 1 wherein the length of said tube is substantially equal to the length of a cigarette.

7. The apparatus as claimed in claim 1 wherein the internal diameter of said tube is greater than the outside diameter of a cigarette.

* * * * *